US010826205B2

(12) United States Patent
Novak

(10) Patent No.: US 10,826,205 B2
(45) Date of Patent: Nov. 3, 2020

(54) DOUBLE WIPING BLADE CONTACT

(71) Applicant: Panduit Corp., Tinley Park, IL (US)

(72) Inventor: Benjamin S. Novak, Lockport, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 16/381,057

(22) Filed: Apr. 11, 2019

(65) Prior Publication Data

US 2019/0319378 A1 Oct. 17, 2019

Related U.S. Application Data

(60) Provisional application No. 62/656,424, filed on Apr. 12, 2018.

(51) Int. Cl.
*H01R 12/50* (2011.01)
*H01R 12/70* (2011.01)
*H01R 12/85* (2011.01)

(52) U.S. Cl.
CPC ..... *H01R 12/50* (2013.01); *H01R 12/7017* (2013.01); *H01R 12/85* (2013.01)

(58) Field of Classification Search
CPC ..... H01R 12/50; H01R 12/7017; H01R 12/85
USPC ..... 439/259
See application file for complete search history.

(56) References Cited

U.S. PATENT DOCUMENTS 4,952,178 A * 8/1990 Beer ..... H01R 13/114 439/842
4,973,273 A * 11/1990 DePriest ..... H01R 13/11 439/856
5,167,544 A * 12/1992 Brinkman ..... H01R 13/11 439/856
5,334,053 A * 8/1994 Noschese ..... H01R 13/112 439/682
5,672,084 A * 9/1997 Feldman ..... H01R 13/11 439/852
6,116,926 A * 9/2000 Ortega ..... H01R 13/6586 439/108
6,217,356 B1 * 4/2001 Davis ..... H01R 4/245 439/181
6,224,432 B1 * 5/2001 Billman ..... H01R 13/113 439/856
6,375,488 B1 * 4/2002 Noro ..... H01R 12/592 439/395
6,383,039 B1 * 5/2002 Yoneyama ..... H01R 13/41 439/682
7,731,537 B2 * 6/2010 Amleshi ..... H01R 13/514 439/607.05
2009/0011664 A1 * 1/2009 Laurx ..... H01R 13/514 439/884

* cited by examiner

*Primary Examiner* — Alexander Gilman

(74) *Attorney, Agent, or Firm* — Christopher S. Clancy; James H. Williams; Christopher K. Marlow

(57) ABSTRACT

A double wiping blade contact assembly has a blade contact and a double wiping contact. The double wiping contact has first and second stage contact wiping areas. The second stage being at a distance from the first stage and wherein the first stage contact wiping area has an upper lead-in flange that guides the blade contact under the first stage contact wiping area and the second stage contact wiping area has a lower lead-in flange that guides the blade contact over the second stage contact wiping area.

2 Claims, 2 Drawing Sheets

DOUBLE WIPING BLADE CONTACT

CROSS REFERENCE TO RELATED APPLICATIONS

This application claims priority to U.S. Provisional Application No. 62/656,424, filed Apr. 12, 2018, the subject matter of which is hereby incorporated by reference in its entirety.

BACKGROUND

Copper connectors are becoming increasingly compact in an effort to achieve a higher density of data channels in a given area, as well as for use in applications where data needs to be transmitted to remote devices, such as security cameras and climate control devices. These compact connectors are generally required to be low cost and relatively simple to manufacture, yet be robust enough to handle connecting and disconnecting under load with no performance degradation.

What is needed is an electrical contact design that can be adapted to a small form factor that is simple and inexpensive to manufacture while featuring multiple points of contact to establish a robust electrical connection.

SUMMARY

A double wiping blade contact assembly has a blade contact and a double wiping contact. The double wiping contact has first and second stage contact wiping areas. The second stage being at a distance from the first stage and wherein the first stage contact wiping area has an upper lead-in flange that guides the blade contact under the first stage contact wiping area and the second stage contact wiping area has a lower lead-in flange that guides the blade contact over the second stage contact wiping area.

DESCRIPTION OF THE INVENTION

The present invention is an electrical contact interface that is comprised of a plurality of two different contacts that touch at two or more different points as their respective connectors are mated together.

Figure 1:
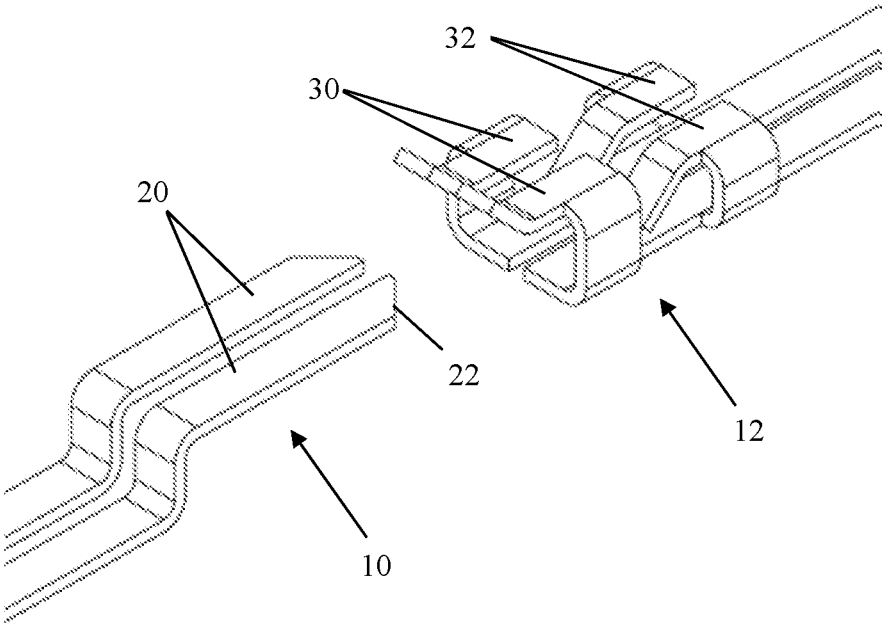
FIG. 1 is an isometric view of a first embodiment of a double wiping contact assembly.

FIG. 1 shows a first embodiment of a double wiping contact assembly which includes a pair of blade contacts 10 and a pair of double wiping contacts 12. The blade contacts 10 will be contained in a connector housing, and the double wiping contacts 12 will be contained in the corresponding mating connector housing. The blade contacts 10 feature long horizontal blades 20 with chamfered leading edges 22.

The double wiping contacts 12 each have first stage contacts 30 and second stage contacts 32 that touch the top and bottom surfaces of the blade contacts 10 to establish electrical connection.

Figure 2:
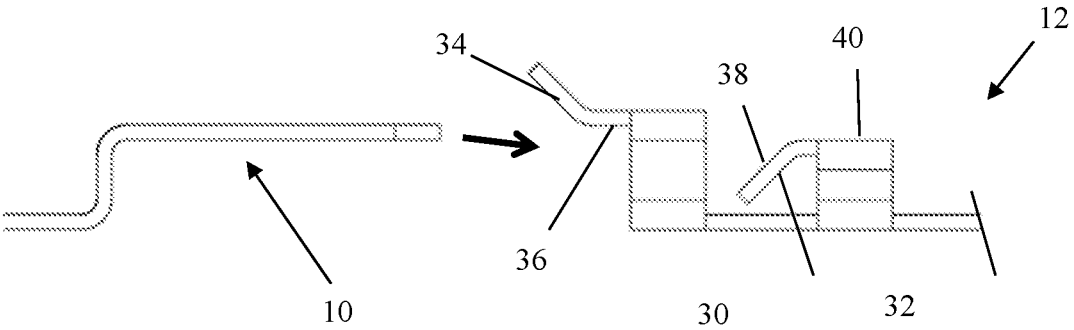
FIGS. 2 and 3 are a side views of the double wiping contact assembly of claim 1.

FIG. 2 shows a side profile view of the contacts prior to mating. The first stage contacts 30 of double wiping contacts 12 have upper lead-in flanges 34 that guide the blade contacts 10 under the first wiping contact area 36. The second stage contacts 32 have lower lead-in flanges 38 that guide the blade contacts 10 over the second wiping contact area 40.

Figure 3:
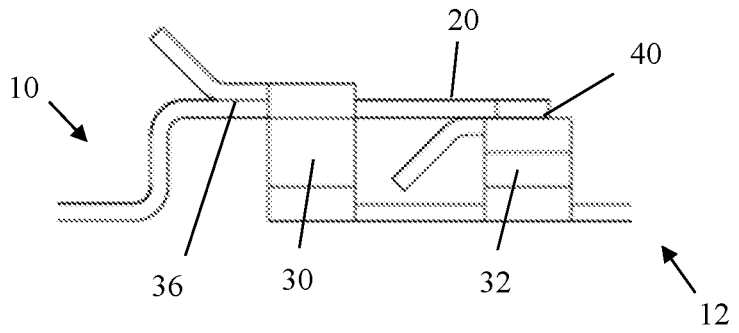

FIG. 3 shows the contacts after being mated together. As the horizontal blades 20 of blade contact 10 are inserted into double wiping contacts 12, they make initial contact with first stage contacts 30. During connection under load, this initial point of contact experiences damage from electrical arc between the two surfaces. As the blade contact 10 continues to be inserted, the horizontal blades 20 slide along the first wiping contact area 36 which keeps constant contact with the blades. The horizontal blades 20 then enter the second stage contacts 32, where the underside of the blades slide along the second wiping contact area 40. This design allows the final point of contact to be located away from the portion of the contacts that was damaged during insertion, creating a more reliable and robust connection. The heights of the first and second stage wiping contacts may also be tuned to increase or decrease the normal force applied on the horizontal blades 20 of blade contact 10 as needed.

Figure 4:
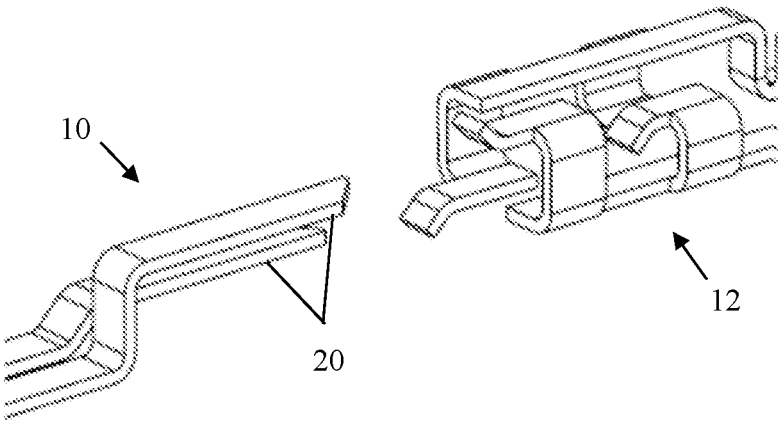
FIG. 4 is a an isomstriv view of a second embodiment of a double wiping contact assembly.

To reduce the risk of the blade contacts touching and shorting on each other, they may be offset. FIG. 4 shows a second embodiment of a double wiping contact assembly with the contact interface with horizontal blades 20 of blade contact 10 offset at different heights to increase the space between the blades. To match the heights of the blades, one of the wiping contacts 12 may be inverted.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

What is claimed:

1. A double wiping blade contact assembly comprising:

first and second blade contacts; and at least one double wiping contact configured to engage each at least one blade contact wherein the each at least one double wiping contact has first and second stage contact wiping areas, the second stage being at a distance from the first stage wherein the first stage contact wiping area has an upper lead-in flange that guides the blade contact under the first stage contact wiping area and the second stage contact wiping area has a lower lead-in flange that guides the blade contact over the second stage contact wiping area wherein the first double wiping blade contact is inverted relative the second double wiping blade contact.

2. The double wiping contact assembly of claim 1 wherein the first blade contact is offset from the second blade contact.

* * * * *